United States Patent [19]

Hong

[11] Patent Number: 5,054,534

[45] Date of Patent: Oct. 8, 1991

[54] WINDOW SHADE WITH DUAL BLINDS

[76] Inventor: Amy Hong, No. 9, Jenn-Shing Lane, Fu-Nan Village, Fu-Shing, Changhua Sheann, Taiwan

[21] Appl. No.: 651,177

[22] Filed: Feb. 6, 1991

[51] Int. Cl.[5] ..... E06B 3/94

[52] U.S. Cl. ..... 160/84.1; 160/123

[58] Field of Search ..... 160/84.1, 168.1, 108, 160/113, 120, 121.1, 123, 126

[56] References Cited

U.S. PATENT DOCUMENTS 3,946,788 3/1976 van Muyen .

4,687,039 8/1987 Chumbley .

*Primary Examiner*—Blair M. Johnson

*Attorney, Agent, or Firm*—Browdy and Neimark

[57] ABSTRACT

A window shade with dual blinds comprises a headrail, a bottom rail, dual blinds arranged in parallel between the head rail and the bottom rail to form an interspace, draw lock for positioning the bottom rail, and a draw cord for lifting and lowering the bottom rail. Each of dual blinds has a plurality of string holes arranged therein at noncorresponding positions so as to obstruct one another.

1 Claim, 3 Drawing Sheets

WINDOW SHADE WITH DUAL BLINDS

BACKGROUND OF THE INVENTION

The present invention relates to a window shade, and more particularly to a window shade designed with dual blinds.

As shown in FIG. 1, a time-honored window blind of prior art has a relatively simple construction, which can be made easily at a low cost. However, it has the following defects that need to be addressed and improved.

(a) The blind made of a thin material can be made more compact after being drawn up together; nevertheless it does not obscure light effectively.

(b) The blind made of a thin material is a poor heat insulator and is also lacking in soundproof quality.

(c) The blind made of a thin material does not effectively obscure or prevent sight of movement of persons in the room at night.

(d) The string holes arranged in the blind permit sunlight or light of other sources to permeate the blind and can be used improperly as peep holes.

A Y-shaped and pleated blind fabric impervious to light was proposed to overcome the shortcomings described above, as described by Judkins in PCT/US88/0091, in which FIG. 2 shows that each of ridges arranged on the same side of the blind fabric has a shoulder of a predetermined width extended outwardly therefrom. A hole is punched at the same position in each of shoulders to accommodate a string so as to enhance the imperviousness of the blind to light. However, such blind fabric is not a feasible substitute in terms of production cost and is still used on a trial basis.

Another solution to the problems mentioned above is a honeycomb blind, as exemplified in Colson U.S. Pat. Nos. 4,450,027 and 4,603,072; Masuda U.S. Pat. No. 3,164,507; Suominer U.S. Pat. Nos. 4,288,485 and 4,388,354; and Anderson U.S. Pat. No. 4,685,986. The honeycomb blind is a workable alternative. However, a costly investment in new production facilities is called for, because the existing production machinery and technology used to make blinds of the conventional types are no longer compatible with the production of a honeycomb blind. In addition, a honeycomb blind has an inherent drawback in itself that it can not be made compact after being rolled up.

SUMMARY OF THE INVENTION

The primary objective of the present invention is to provide a window shade with dual blinds having simple structures and capable of obscuring light, insulating heat, and keeping sound from coming through, which can be manufactured easily without an addition of new machinery to existing production facilities.

In keeping with the principles of the present invention, the primary objective is accomplished by a window shade comprising a headrail, a bottom rail, dual blinds arranged between the headrail and the bottom rail, a draw lock, and a draw cord. The window shade of the present invention is characterized in that it comprises dual blinds arranged in parallel between the headrail and the bottom rail to form an interspace therebetween. In addition, the string holes in dual blinds are not arranged at corresponding positions so that they obstruct one another.

DETAILED DESCRIPTION OF THE PREFERRED EMBODIMENT

Figure 1:
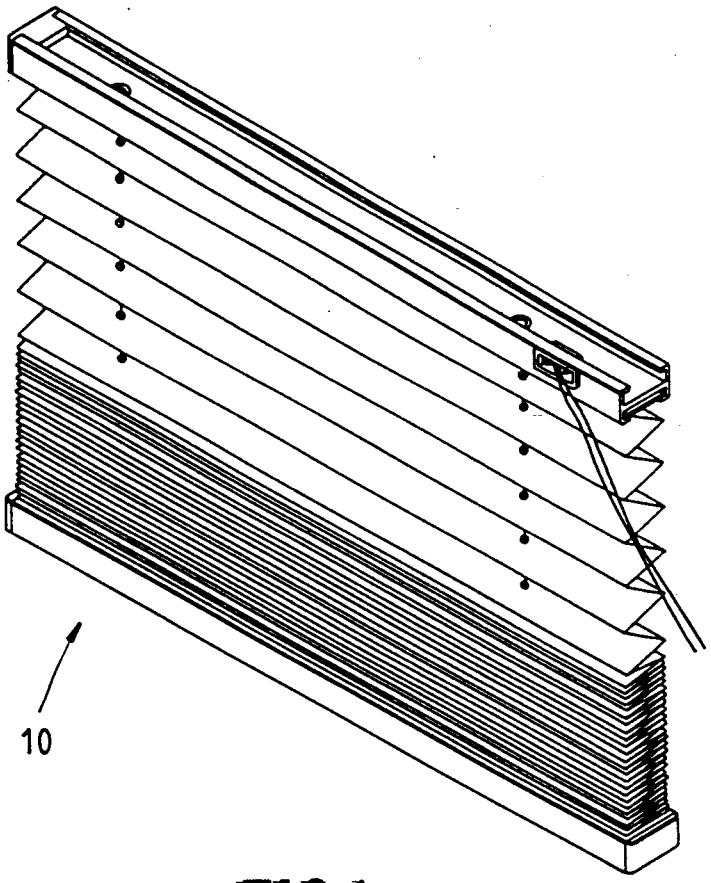
FIG. 1 PRIOR ART
FIG. 1 shows an external and three-dimensional view of a window shade of prior art.
Figure 2:
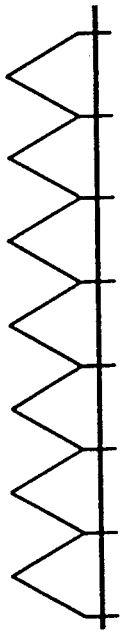
FIG. 2 PRIOR ART
FIG. 2 shows a view of structure of a Y-shaped window blind of prior art.
Figure 3:
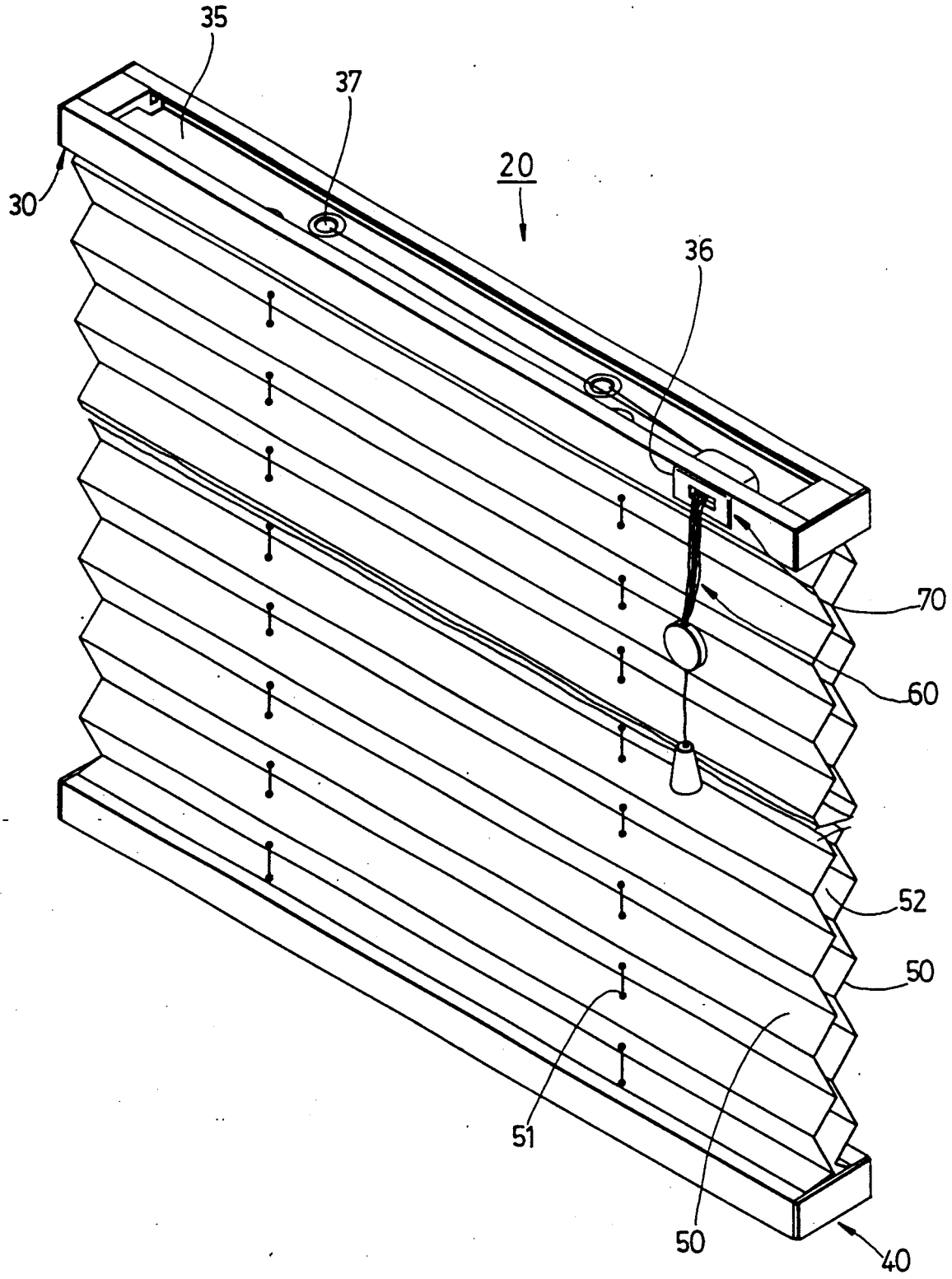
FIG. 3 shows an external and three-dimensional view of the preferred embodiment according to the present invention.
Figure 6:
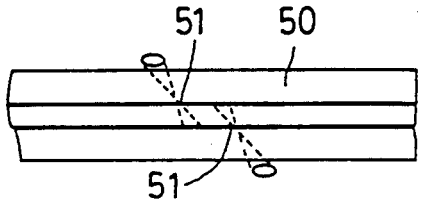
FIG. 6 shows a schematic view of positions of string holes embodied in the present invention.
Figure 5:
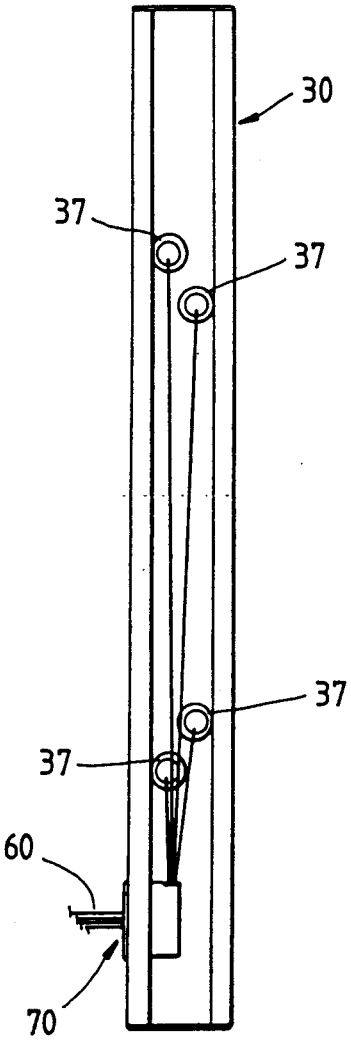
FIG. 5 shows a top view taken from the preferred embodiment shown in FIG. 3.
Figure 4:
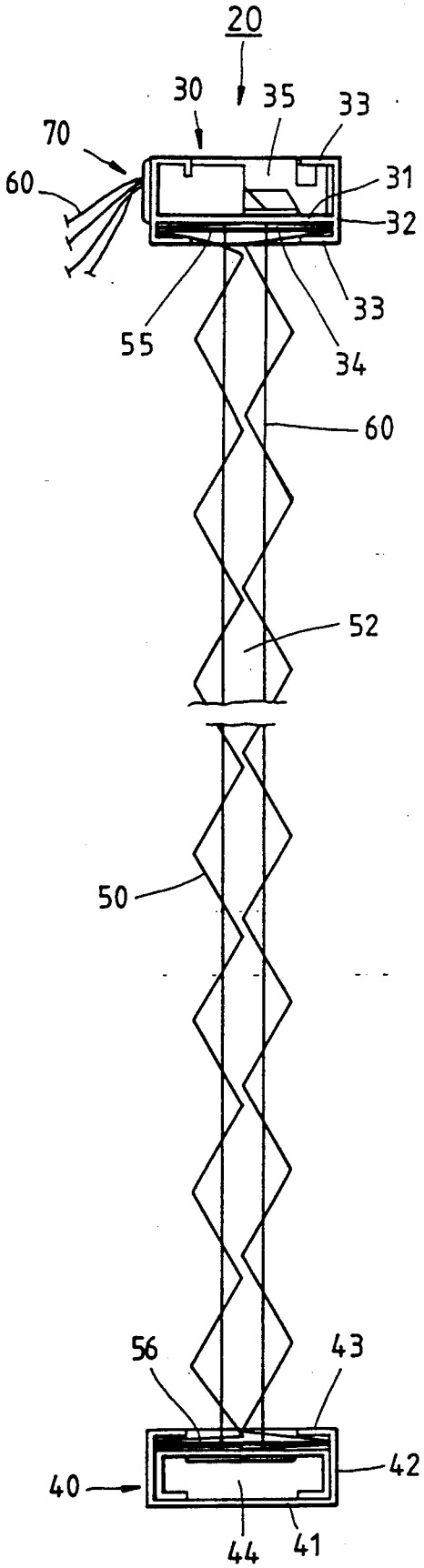
FIG. 4 shows a view taken from the side of the preferred embodiment shown in FIG. 3.

Referring to FIGS. 3–5, a window shade 20 embodied in the present invention is shown comprising a headrail 30 with an elongated flat panel 31 disposed therein. Two face plates 32 perpendicular to long sides of the flat panel 31 are constructed. The upper and the lower ends of these two face plates extend inwardly to form a shoulder plate 33, which in turn forms a bottom receiving slot 34 and a top receiving slot 35 in the headrail 30. A bore hole 36 penetrating the face plate 32 is arranged at one side of the upper receiving slot 35. Four bore holes 37 are arranged at predetermined positions on the flat panel 31 in a nonreciprocal manner.

The bottom rail 40 embodied in the present invention comprises a bottom panel 41, which extends upwards along the long side thereof to form a face plate 42 whose upper end extends inwardly to form a shoulder plate 43 so that a receiving slot 44 is constructed in the bottom rail 40.

Two blinds 50 are fastened respectively to two positioning plates 55 and 56 in such a manner that they are arranged in parallel at a predetermined interval so as to form therebetween an interspace 52. Both ends of blinds 50 are set into the receiving slots 34 and 44 of the headrail 30 and the bottom rail 40 respectively by means of positioning plates 55 and 56. In addition, string holes 51 are arranged in both blinds 50 in a nonreciprocal manner so that they obstruct one another.

One end of each of four draw cords 60 is fastened securely to the lower positioning plate 56 while the other end of each of four draw cords 60 comes out of the cord hole 36 after traversing a set of string holes 51, the upper positioning plate 55 and the bore hole 37. These draw cords 60 are provided to serve as means to lift or lower the bottom rail 40.

A draw lock 70 arranged in the cord hole 36 is provided to lock in the draw cords 60 so as to determine the desired position level of the bottom rail 40.

On the basis of unique design and construction of the embodiment of the present invention described above, it has become apparent that the dual blinds 50 provided in the window shade of the present invention are capable of hindering the light effectively. In addition, an interspace 52 formed between dual blinds 50 serves as a space for the light, which happens to permeate the first blind, to reflect back and forth between first and second blinds so as to enhance the effect of obstruction of light. Furthermore, the interspace 52 also serves as an effective insulator of light energy as well as sound wave.

Another advantage of the present invention is that the projection on the window shade of an illuminated object or human body present in the room at night is effectively obstructed in the interspace 52, wherein a repetitious interference of projection takes place.

Still another advantage of the present invention is that string holes 51 arranged respectively in dual blinds 50 are positioned to form a predetermined angle to obstruct one another so that string holes 51 can not be used improperly as peep holes.

The embodiment of the present invention described above is to be considered in all respects as merely an illustration of principles of the present invention. Accordingly, the present invention is to be limited only by the scope of the hereinafter appended claims.

What is claimed is:

1. A window shade with dual blinds comprising:

(a) a headrail;

(b) a bottom rail;

(c) dual blinds each having a length and a width arranged in parallel between said headrail and said bottom rail and being substantially coextensive so as to form an interspace located therebetween, each of said dual blinds having string holes arranged therein at offset noncorresponding positions along the width thereof to obstruct one another;

(d) means of positioning said bottom rail, wherein positioning means includes a draw lock; and (e) means for lifting and lowering said bottom rail, wherein said lifting and lowering means includes a draw cord.

* * * * *